US006578946B1

(12) United States Patent
Schantz

(10) Patent No.: US 6,578,946 B1
(45) Date of Patent: Jun. 17, 2003

(54) MOVABLE INK DROP DETECTOR PICK UP FOR A DROP-ON-DEMAND PRINTER

(75) Inventor: Christopher A. Schantz, Redwood City, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/104,821

(22) Filed: Mar. 22, 2002

(51) Int. Cl.[7] ..... B41J 2/165
(52) U.S. Cl. ..... 347/22; 347/33; 347/81
(58) Field of Search ..... 347/22, 33, 31, 347/32, 1, 19, 81

(56) References Cited

U.S. PATENT DOCUMENTS 4,074,217 A * 2/1978 Yanagawa ..... 355/30
4,683,481 A 7/1987 Johnson ..... 346/140
5,255,009 A * 10/1993 Bauer et al. ..... 346/25
5,276,970 A 1/1994 Wilcox et al. ..... 33/18.1
5,278,584 A 1/1994 Keefe et al. ..... 346/140 R
5,980,018 A 11/1999 Taylor et al. ..... 347/31
6,086,190 A * 7/2000 Schantz et al. ..... 347/81
6,454,374 B1 * 9/2002 Therien ..... 347/1

* cited by examiner

*Primary Examiner*—Anh T. N. Vo
*Assistant Examiner*—Ly T Tran

(57) ABSTRACT

The present invention is directed to a system and method for a waste ink removal apparatus for cleaning ink residue from an ink drop detection sensor in a printing mechanism, comprising an assembly pivotally supported by a pivot, the assembly pivoting between a first orientation and a second orientation; an ink drop sensor located on the assembly; a pivoting device connected to the assembly and an absorbent pad located to contact the ink drop sensor when the assembly is in the second orientation, wherein operation of the pivoting device causes the assembly to pivot between the first and second orientations such that waste ink is removed from the ink drop sensor when the assembly is in the second orientation.

24 Claims, 4 Drawing Sheets

MOVABLE INK DROP DETECTOR PICK UP FOR A DROP-ON-DEMAND PRINTER

RELATED APPLICATIONS

The present application is related to previously filed, commonly assigned U.S. patent application Ser. No. 09/940,313, filed Aug. 27, 2001, entitled "DETERMINING INKJET PRINTER PEN TURN-ON VOLTAGES", U.S. patent application Ser. No. 09/915,980, filed Jul. 25, 2001, entitled "INK DROP SENSOR", U.S. patent application Ser. No. 09/915,461, filed Jul. 25, 2001, entitled "INK DROP DETECTOR", U.S. Patent application Ser. No. 09/773,881 filed Jan. 31, 2001, entitled "UNI-DIRECTIONAL WASTE INK REMOVAL SYSTEM", and U.S. patent application Ser. No. 09/773,873, filed Jan. 31, 2001, entitled "INK DROP DETECTOR WASTE INK REMOVAL SYSTEM", the disclosures of which are hereby incorporated by reference in their entireties.

TECHNICAL FIELD

The present invention relates to the field of printers and, more particularly, to a low cost ink drop detector for use in a drop-on-demand printer.

BACKGROUND

Prior printers including black and white and color printers commonly include at least one printhead that ejects ink drops onto paper. Such printheads may include multiple nozzles through which ink drops are ejected. A printhead may eject ink in response to a drive signal generated by print control circuitry in the printer. A printhead that ejects ink drops in response to drive signals may be referred to as a drop-on-demand printhead.

An inkjet printhead is an example of a drop-on-demand printhead. Inkjet printheads are capable of forming an image on different types of media. The inkjet printhead may eject droplets of colored ink through a plurality of orifices or nozzles onto a given media, such as paper, as the media is advanced through a "printzone" or platen area. The printzone may be defined by the planar area that is accessible by the printhead orifices due to any scanning and/or reciprocating movement of the printhead in relation to the media. Examples of methods for expelling ink from the printhead orifices, or nozzles, include known piezo-electric and thermal techniques. For instance, two earlier thermal ink ejection mechanisms are shown in U.S. Pat. Nos. 5,278,584 and 4,683,481, both assigned to the present assignee, Hewlett-Packard Company, and hereby incorporated in their entireties by reference.

In order to achieve a high level of image quality in an inkjet printing mechanism, it is often desirable that the printheads exhibit several qualities, including: consistent and small ink drop size, consistent ink drop trajectory from the printhead nozzle to the print media, and inkjet nozzles that do not easily clog. To this end, inkjet printing mechanisms may include a service station for the maintenance of the inkjet printheads. These service stations may include scrapers, ink-solvent applicators, primers, and caps to help keep the nozzles from drying out during periods of inactivity. Additionally, inkjet printing mechanisms may contain service routines that are designed to exercise the printhead by firing ink out of each of the nozzles into a waste spittoon in order to prevent the formation of dried ink resulting in nozzle clogging.

Despite these preventative measures, there are many factors at work within an inkjet printing mechanism that may clog the inkjet nozzles, resulting in inkjet nozzle failures. For example, paper dust particles may collect on and eventually clog the nozzles. Ink residue from ink aerosol or from partially clogged nozzles may be spread by service station printhead scrapers into open nozzles thereby clogging additional nozzles. Accumulated precipitates from the ink inside of the printhead may also occlude the ink channels and the nozzles. Additionally, heater elements in a thermal inkjet printhead may fail to energize thereby causing the nozzle to fail.

Clogged or failed printhead nozzles may result in objectionable and easily noticeable print quality defects such as banding (visible bands of different hues or colors in what would otherwise be a uniformly colored area) or complete color voids in the image. In fact, inkjet printing systems are so sensitive to clogged nozzles, that a single clogged nozzle out of hundreds may be noticeable and objectionable in the printed output.

Prior printers typically lack a mechanism for determining whether the print head actually requires cleaning. Such printers may apply a service station to the print head based on a determination that the print head may possibly require cleaning. Unfortunately, such printers must then employ periodic cleaning, rather than cleaning when necessary, that usually slows the overall printing throughout and may result in unnecessary maintenance ink loss and wear, or may fail to prevent a failure if performed too infrequently.

In order to detect whether an inkjet printhead nozzle is firing, a printing mechanism may be equipped with a low cost ink drop detection system, such as the one described in U.S. Pat. No. 6,086,190, which is assigned to the present assignee, Hewlett-Packard Company, and is incorporated herein by reference in its entirety. This drop detection system utilizes an electrostatic sensing element that is imparted with an electrical stimulus when struck by a series of ink drop bursts ejected from an inkjet printhead.

In practical implementation, however, this electrostatic sensing element may have some limitations. The sensing element may adversely react with ink residue formed as a result of contact with the ink drop bursts. Additionally, drop detect signals provided from the sensing element to the sensing electronics may easily be subjected to noise due to their relatively small amplitudes. Furthermore, the ink residue remains conductive and may short-circuit the sensing electronics.

Another possible method for detecting the ejection of ink drops from a print head is to equip the printer with a drop detection station that employs piezo-electric material and associated circuitry that detects the impact of the ink drops hitting the detection station. Unfortunately, such piezo-electric material is relatively expensive and adds to the manufacturing cost of a printer. In addition, such a mechanism usually cannot detect extremely small ink drops that are used in high resolution and color printers. Moreover, piezo-electric material may lose sensitivity as ink accumulates on its surface thereby reducing its ability to detect ink drop impacts.

Another possible solution is to equip the printer with an optical detector that includes a light source and a detector. An ink jet nozzle may be aimed so that ink drops pass between the light source and the detector and occlude light rays that travel between the light source and the detector. The circuitry for such an optical detector may unduly add to the manufacturing cost of a printer. In addition, such a technique may require very fine control over the positioning of the optical detector with respect to nozzles being tested.

Moreover, mist or spray from the nozzle may contaminate the optical detector and cause reliability problems.

Another possible solution that is specific to thermal ink jet print heads is to equip the print head itself with an acoustic detector. Such an acoustic drop detector may detect the shock wave associated with the collapse of ink bubbles in the print head. Such ink bubble shock waves may, however, occur even though ink is not being ejected from the print head. In addition, acoustic measurements may be corrupted by large current pulses that occur during printer operation. Moreover, the acoustic detector and associated signal amplifier circuitry for such an acoustic detector may unduly increase the overall manufacturing costs of a printer.

Therefore, it would be desirable to have a sensing element that have substantial immunity from the potentially harmful effects of ink residue and that may be easily integrated into various printing mechanism designs. It would also be desirable to have a method of efficiently and economically constructing such a sensing element. It would also be desirable to have a more effective system for cleaning inkjet nozzles.

SUMMARY OF THE INVENTION

The present invention is directed to a system and method for a waste ink removal apparatus for cleaning ink residue from an ink drop detection sensor in a printing mechanism, including an assembly pivotally supported by a pivot, the assembly pivoting between a first orientation and a second orientation; an ink drop sensor located on the assembly; a pivoting device connected to the assembly and an absorbent pad positioned to contact the ink drop sensor when the assembly is in the second orientation, wherein operation of the pivoting device causes the assembly to pivot between the first and second orientations such that waste ink is removed from the ink drop sensor when the assembly is in the second orientation.

DETAILED DESCRIPTION

Figure 1:
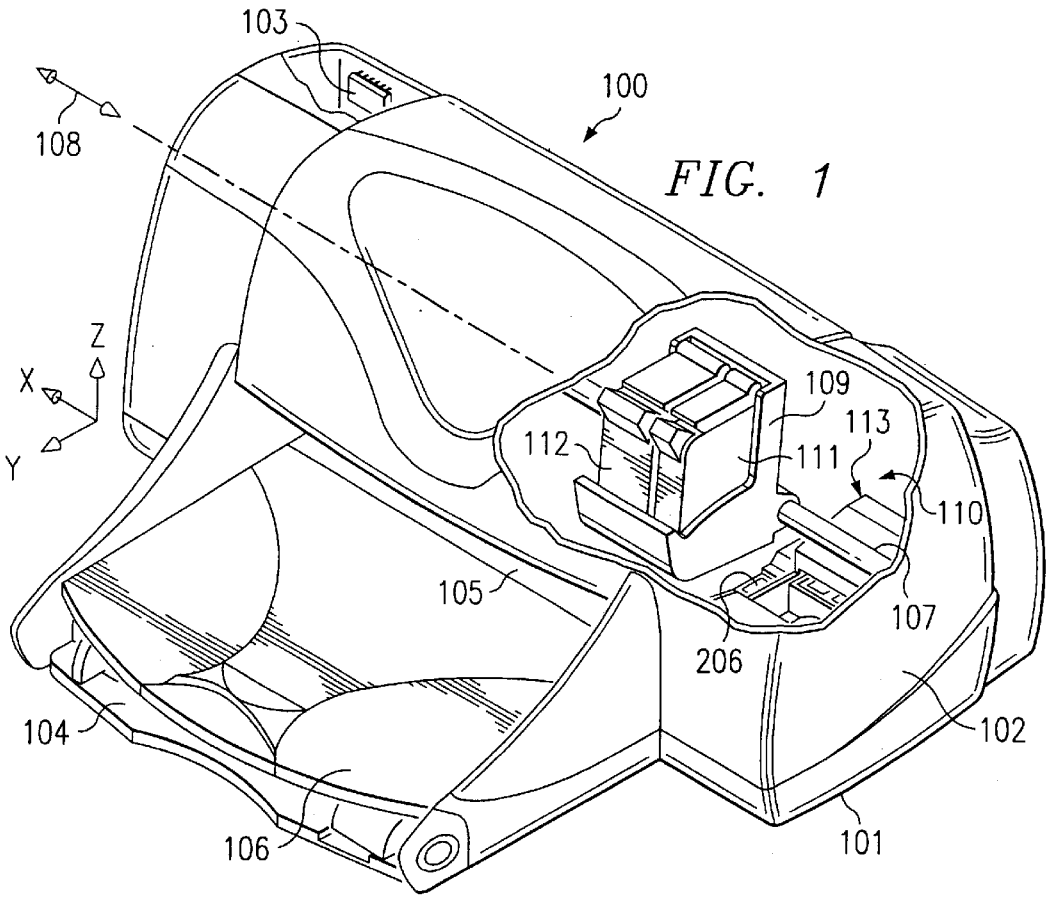
FIG. 1 is a fragmented perspective view of an inkjet printing mechanism illustrating an embodiment of an ink drop sensor.

FIG. 1 illustrates an embodiment of a printing mechanism, here shown as inkjet printer 100, constructed in accordance with an embodiment of the present invention, that may be used for printing on a variety of media, such as paper, transparencies, coated media, cardstock, photo quality papers, and envelopes in an industrial, office, home or other environment. A variety of inkjet printing mechanisms are commercially available. For instance, some of the printing mechanisms that may embody the concepts described herein include desk top printers, portable printing units, wide-format printers, hybrid electrophotographic-inkjet printers, copiers, cameras, video printers, and facsimile machines, to name a few. For convenience of illustration only, the concepts introduced herein are described in the environment of inkjet printer 100.

While it is apparent that the printer components may vary from model to model, typical inkjet printer 100 includes chassis 101 surrounded by a frame or enclosure 102, typically of a plastic material. Printer 100 also has a printer controller, illustrated schematically as microprocessor 103, that receives instructions from a host device, such as a computer or Personal Data Assistant (PDA) (not shown). A screen coupled to the host device may also be used to display visual information to an operator, such as the printer status or a particular program being run on the host device. Printer host devices, such as computers and PDAs, their input devices, such as a keyboards, mouse devices, and stylus devices, and output devices, such as liquid crystal display screens and monitors, are all well known to those skilled in the art.

A conventional print media handling system (not shown) may be used to advance a sheet of print media (not shown) from media input tray 104 through printzone 105 and to output tray 106. Carriage guide rod 107 is mounted to chassis 101 to define scanning axis 108, with carriage guide rod 107 slideably supporting printhead assembly or carriage assembly 109 for side-to-side, reciprocal travel across printzone 105. A conventional carriage drive motor (not shown) may be used to propel carriage assembly 109 in response to a control signal received from controller 103. To provide carriage positional feedback information to controller 103, a conventional encoder strip (not shown) may be extended along the length of printzone 105 and over peripheral servicing region 110.

Carriage assembly 109 holds the two inkjet cartridges 111, 112. Carriage guide rod 107 allows carriage assembly 109 to traverse back and forth in the direction of scanning axis 108. A conventional optical encoder reader may be mounted on a back surface of carriage assembly 109 to read positional information provided by the encoder strip, for example, as described in U.S. Pat. No. 5,276,970, which is assigned to Hewlett-Packard Company, the present assignee and is hereby incorporated by reference in its entirety. Note that the manner of providing positional feedback information via the encoder strip reader, may also be accomplished in a variety of ways.

In printzone 105, the print media receives ink from an inkjet cartridge, such as black inkjet cartridge 111 and/or color inkjet cartridge 112. Cartridges 111 and 112 are also often called "pens" by those in the art. Black pen 111 is illustrated herein as containing a pigment-based ink. For the purposes of illustration, color pen 112 is described as containing three separate dye-based inks that are colored cyan, magenta, and yellow, although color pen 112 may also contain pigment-based inks in some implementations. Other types of inks may also be used in pens 111 and 112, such as paraffin-based inks, as well as hybrid or composite inks having both dye and pigment characteristics.

Printer 100 as illustrated uses replaceable printhead cartridges where each pen has an integral reservoir that carries the entire ink supply as the printhead reciprocates over printzone 105. As used herein, the term "pen" or "cartridge" may also refer to an "off-axis" ink delivery system, having main reservoirs (not shown) for each ink (black, cyan, magenta, yellow, or other colors depending on the number of inks in the system) located in an ink supply region.

In an off-axis system, the pens may be replenished by ink conveyed through a conventional flexible tubing system from the stationary main reservoirs that are located "off-axis" from the path of printhead travel, so only a small ink supply is propelled by carriage assembly 109 across printzone 105. Other ink delivery or fluid delivery systems may also employ the systems described herein, such as "snapper" cartridges that have ink reservoirs that snap onto permanent or semi-permanent print heads.

The black pen 111 as illustrated has a printhead (not shown) that ejects black ink, and color pen 112 has a tri-color printhead (not shown) that ejects cyan, magenta, and yellow inks corresponding to the three primary subtractive colors. The printheads selectively eject ink to form an image on a sheet of media when the media is in printzone 105. The printheads each have an orifice plate with a plurality of nozzles formed therethrough. The nozzles of each printhead are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to scanning axis 108, with the length of each array determining the maximum image swath for a single pass of the printhead. The pens may include thermal inkjet printheads, although other types of printheads may be used, such as piezoelectric printheads. The thermal printheads typically include a plurality of resistors that are associated with the nozzles. Upon energizing a selected resistor the resultant thermal energy causes a bubble of gas to be formed that ejects a droplet of ink from the nozzle and onto a portion of the print media in printzone 105 under the nozzle. The printhead resistors are selectively energized in response to firing command control signals delivered from controller 103 to carriage assembly 109. During or after printing, carriage assembly 109 may be moved along carriage guide rod 107 to servicing region 110 where service station 113 may perform various servicing functions, such as, priming, scraping, and capping for storage during periods of non-use to prevent ink from drying and clogging the inkjet printhead nozzles.

Figure 2:
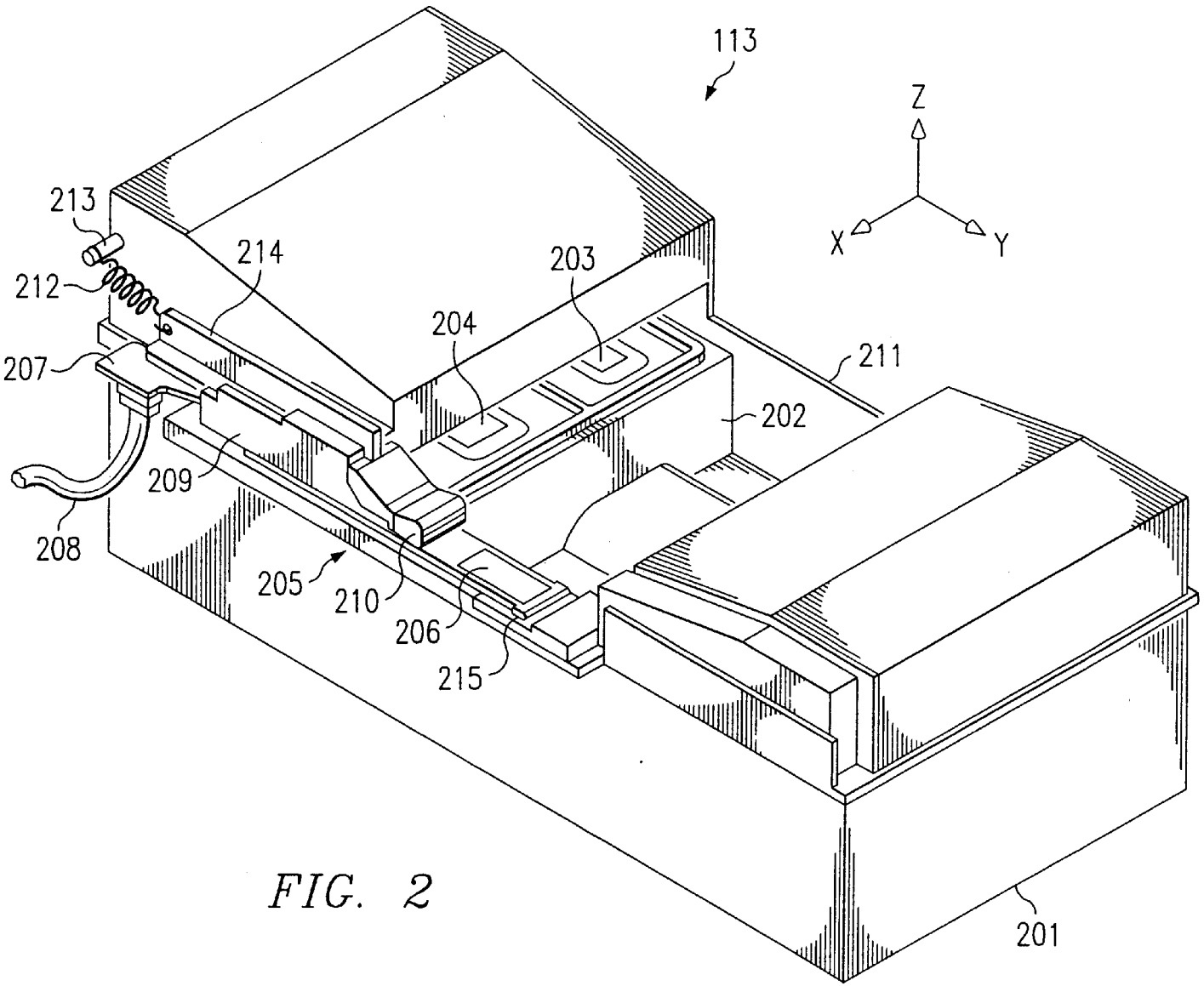
FIG. 2 is an enlarged, perspective view of an ink drop sensor attached to an ink printhead service station of FIG. 1.

FIG. 2 shows service station 113 in detail. Service station frame 201 is mounted to chassis 101, and houses moveable pallet 202. Moveable pallet 202 may be driven by a motor (not shown) to move in frame 201. Moveable pallet 202 may be driven in the positive and negative Y-axis directions by a motor and rack and pinion gear train in response to microprocessor 103 according to methods known by those skilled in the art. An example of such a rack and pinion system in an inkjet cleaning service station may be found in U.S. Pat. No. 5,980,018, assigned to Hewlett-Packard Company, also the current assignee, hereby incorporated in its entirety by reference. The end result is that moveable pallet 202 may be moved in the positive Y-axis direction to a servicing position and in the negative Y-axis direction to an uncapped position. Moveable pallet 202 supports black printhead cap 203 and tri-color printhead cap 204 to seal the printheads when moveable pallet 202 is in the servicing position.

FIG. 2 also shows an embodiment of ink drop sensor 205 supported by service station frame 201. Ink drop sensor 205 may also be called an ink drop detector. While depicted in a particular location for purposes of the present illustration, ink drop sensor 205 may be mounted in other locations along the scanning axis 108, including, for example, the right side 211 of the service station frame 201, inside service station 113, or on the opposite end of the printer from service station 113. Within sensor 205 are integrated a sensing element or "target" 206 and electrical components (not shown) for filtering and amplification of the signals from target 206. Target 206 may also be referred to as an electrostatic sensing element. Sensor 205 may be assembled on a single Printed Circuit Board (PCB) 207. PCB 207 may also be called a Printed Circuitboard Assembly (PCA) or an Electrostatic Drop Detection (EDD) pickup PCA. Electrical conductor 208 connects ink drop sensor 205 to controller 103 for drop detection signal processing. Also shown in FIG. 2 is scraper 210 attached to slider cover 209 that is propelled by a scraper slider 214. Scraper slider 214 is attached via return spring 212 to post 213 projecting from service station frame 201.

Slider cover 209 is attached to PCB 207 and acts as a guide for the movement of scraper slider 214. Slider cover 209 may also be designed to shield electrical components on ink drop detector 205 from ink aerosol generated from the printheads. Scraper slider 214 is capable of being moved in the positive and negative Y-axis directions, and is biased towards the rear of service station 113 (negative Y-axis direction) by a biasing member, such as tension or return spring 212. Return spring 212 is connected between scraper slider 214 and post 213 projecting from service station frame 201. Scraper slider 214 has scraper 210 attached or preferably overmolded onto a front end of slider cover 209. The width of scraper 210 is preferably sufficient to scrape the entire width of target 206. Scraper 210 is preferably constructed of an elastic member, such as a Thermoplastic Elastomer (TPE) that is overmolded onto slider cover 209. Scraper 210 may also be constructed of a non-overmolded, rigid one-piece plastic. Return spring 212 is preferably mounted at an angle above slider cover 209 in order to impart a minimal downward scraping force to scraper 210, thereby minimizing the wear of target 206.

Ink drop sensor 205 may also include a uni-directional waste ink removal system 215 for removing ink from target 206. Waste ink removal system 215 may be constructed of cellulose or polyester, but is preferably constructed of a sintered plastic. Waste ink removal system 215 is configured to receive ink scraped from target 206 when scraper 210 is moved in the positive Y-axis direction across the target 206 and onto the absorber deposition surface. Movement is preferably imparted to scraper 210 by scraper slider 214 through movement of moveable pallet 202 as moveable pallet 202 moves from the uncapped position shown in FIG. 2 to servicing position in the positive Y-axis direction.

Figure 3:
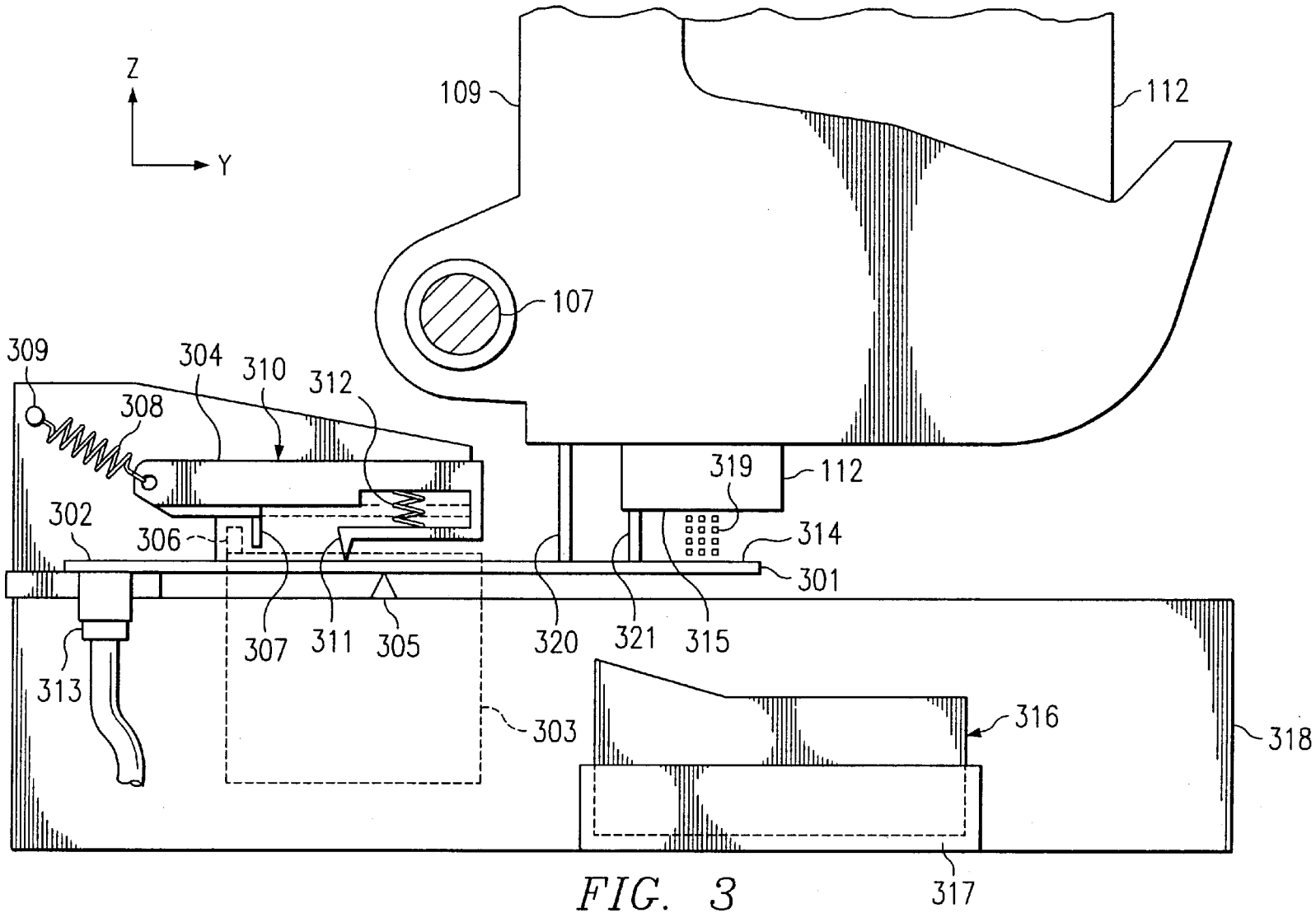
FIG. 3 is an enlarged, side elevation view of a service station of an embodiment of the present invention for use with FIG. 1 shown with an inkjet printhead firing ink into the electrostatic ink drop detector and an Electrostatic Drop Detection (EDD) PCA in a first or measuring position.
Figure 4:
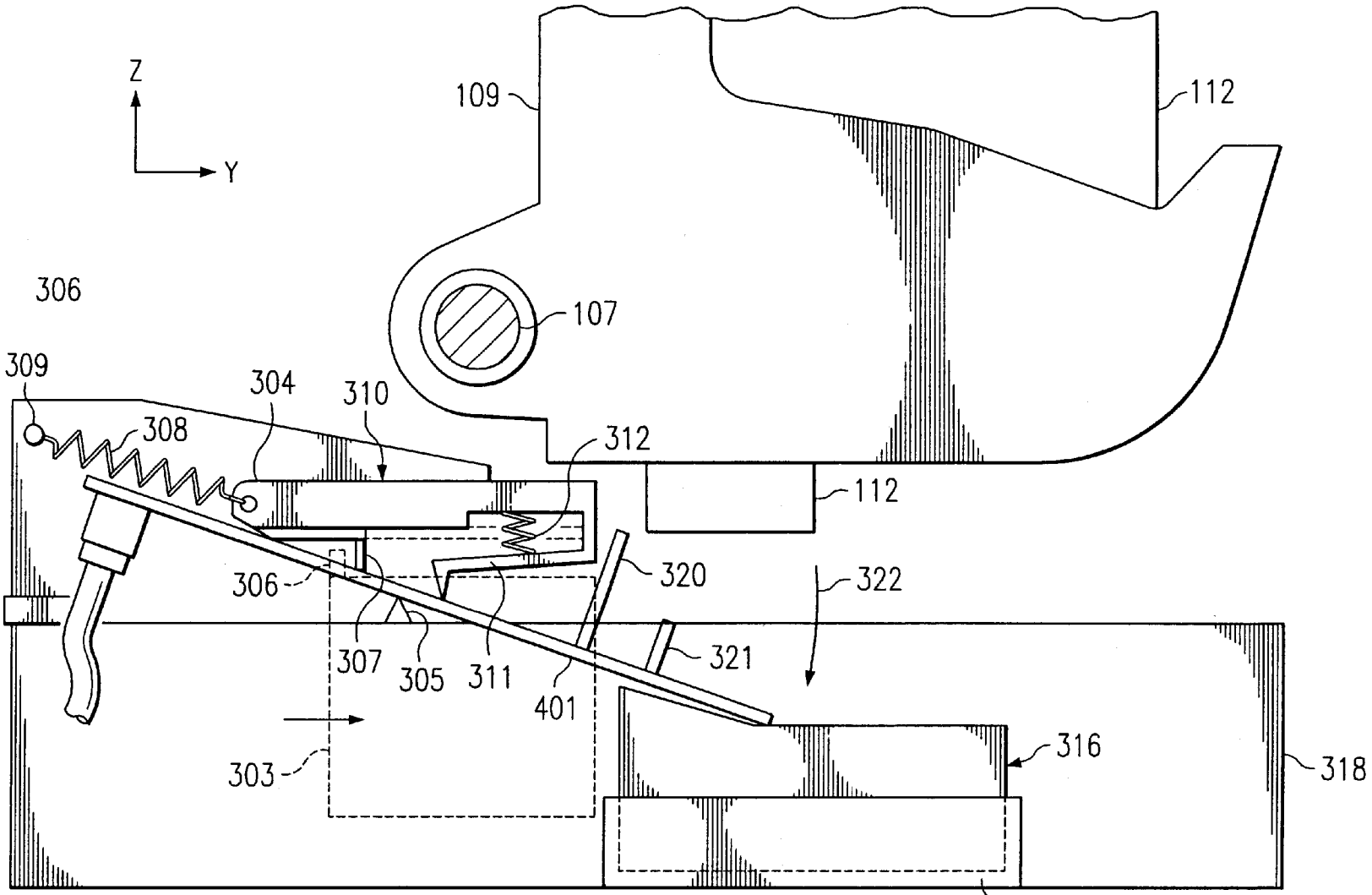
FIG. 4 is an enlarged, side elevational view of the service station of an embodiment of the present invention for use with the inkjet printing mechanism of FIG. 1 shown with a EDD PCA in a second or rest position.

FIGS. 3 and 4 show an alternate method of removing the waste ink from target 206. In this embodiment, PCB 302 is mounted so that it may pivot or translate between two positions, a measuring position 301 (FIG. 3) and a rest or waste removal position 401 (FIG. 4).

FIG. 3 shows PCB 302 in a measuring position. PCB 302 is moved into the measuring position through the interaction of retractor spring 308, moveable pallet 303, slider cover 304 and PCB pivot 305. Moveable pallet 303 may be another actuator that allows the PCB to pivot between the measuring position and the rest position. As previously described, moveable pallet 303 may move between an uncapped position (as shown in FIG. 2) and a servicing position (moveable pallet is moved in the positive Y-axis direction of FIG. 2). Retractor spring 308 attaches retaining post 309 to slider cover 304. When moveable pallet 303 is in the uncapped position (as shown in FIG. 2), retractor spring 308 ensures slider cover 304 is in retracted position 310 or horizontally translates to the left in FIG. 3. In retracted position 310, slider arm 311 of slider cover 304 biases PCB 302 in the negative Y-axis direction with respect to PCB pivot 305 (to the left of PCB pivot 305 in FIG. 3). When slider arm 311 of slider cover 304 is exerting a pressure (in cooperation with spring 312) in the negative Z-axis direction (downward in FIG. 3) to the left of PCB pivot 305, PCB 302 is positioned in measuring position 301. Flexible electrical conductor 313 links ink drop sensor 314 to controller 103 for drop detection signal processing. Flexible electrical conductor 313 may transmit the raw unamplified or processed Electrostatic Drop Detection (EDD) signal or may transmit an amplified signal if electronics are present on PCB 302. Moveable pallet may also be positioned in a negative Y-axis direction from the position shown in FIG. 3 in that pallet tower 306 does not contact slider cover extrusion 307. In this position the service station may perform other functions including wiping excess ink from pens. Note that these various functions each use the same mechanical assembly.

Color inkjet cartridge or black inkjet cartridge or color pen 112 is shown both above and below carriage assembly 109. When PCB 302 is in measuring position 301, ink drop sensor 314 is pivoted in an upward position that enables ink drops 319 to be detected by ink drop sensor 314 from nozzles (not shown) associated with color pen 112 or black pen (not shown). Nozzles or drop ejection mechanism (not shown) are located on face 315 of printhead or pens. Absorbent pad 316 is designed to wick excess ink from ink drop sensor 314 when PCB 302 is in the rest or waste removal position 401. Absorbent pad 316 may be mounted in absorbent pad container 317. Absorbent pad 316 and absorbent pad container 317 may be configured as part of, attached to, or located near service station assembly 318.

FIG. 3 also shows first spacer 320 and second spacer 321 that may be used individually or together to ensure the proper spacing between the pens and PCA 302. First spacer 320 and second spacer 321 of an embodiment of the present invention represent one embodiment of a specific mechanical arrangement to ensure the distance between the pens and the pickup assembly, PCA 302 or electrostatic drop detectors assembly, is held constant at a specific known distance from the print head in one position. The fixed distance ensures a uniform electrical field between pen 112 and ink drop sensor 314 to ensure the amplitude of the electrical field does not vary between detection events. First spacer 320 shows one embodiment of a spacer that determines the print head to pick up space while second spacer 321 shows another embodiment of a spacer that determines the printhead-to-pickup space. Spacers 320 and 321 may be fastened to PCB 302 that may include other support electronics. In the embodiment depicted in FIGS. 3 and 4 first and second spacers 320 and 321 are used together and are permanently attached to PCA 302 and translate with PCA 302. Spacers may be used to contact either the carriage assembly 109 or the face of at least one of the pens. Note that the spacers may also be mounted on the carriage assembly or the pens.

FIG. 4 is an enlarged, side elevational view of a service station of an embodiment of the present invention for use with FIG. 1 shown with EDD PCA in a second or rest position. As moveable pallet 303 is moved in the positive Y-axis direction (toward the right of FIG. 4) pallet tower 306 engages slider cover extrusion 307. As moveable pallet 303 moves forward, the interaction between pallet tower 306 and slider cover extrusion 307 forces slider cover 304 to also move (horizontally translate) in the positive Y-axis direction (towards the right of FIG. 4). This horizontal translation of slider cover 304 causes retraction spring 308 to expand. Furthermore, as slider cover 304 horizontally translates to the right of FIG. 4, slider arm 311 of slider cover 304 moves towards in the positive Y-axis direction (towards the right of FIG. 4) until slider arm 311 is on the right of PCB pivot 305. Slider arm 311, in cooperation with spring 312, exerts a force in the negative Z-axis direction (downward in FIG. 4) resulting in PCB 302 coming to rest in the waste removal position 401. While PCA 302 is in waste removal position 401 ink drop sensor 314 contacts absorbent pad 316 and excess ink on ink drop sensor 314 is absorbed. This excess ink is stored in absorbent pad container 317, preventing a build up of ink on ink drop sensor 314. As described in U.S. Pat. No. 6,086,190, without an excess ink removal capability, a large build up of ink occurs on the pick up that eventually inhibits the operation of the device of the EDD device. Note PCB 302 alternates between measuring position 301 and waste removal position 401 through the interaction of retractor spring 308 and movement of moveable pallet 303. This rotation in PCB 302 is along the path indicated by arrow 322.

Note that provision may be included that would ensure that PCB 302 would be positioned in its waste removal position when carriage assembly 109 is positioned over the service station.

Note also that the present invention may be practiced in a number of different embodiments. In other embodiments, PCB 302 may be translated between two positions vertically or laterally. An embodiment of the present invention may include the use of spacers to ensure that in a first position a fixed distance is present between the nozzles of the pens and the electrostatic drop detection system such as PCB 302. An embodiment of the present invention may also include that in a second position the ink drop sensor contacts a absorbent system that prevents the build-up of excess ink on the ink drop sensor.

In a preferred embodiment, PCB 302 would be positioned in the rest or waste removal position during printing. In this position PCB 302 will not interfere with the movement of carriage assembly 109. Additionally, during this time excess ink is removed from ink drop sensor 314. When the programming within microprocessor 103 calls for a measurement of the nozzles of the printhead, such as during a pause in printing or after an extended period of nonuse, at the completion of printing or prior to printing, the appropriate nozzles of the printhead would be positioned over ink drop sensor 314. PCB 302 would be positioned in the measuring position and the proper spacing would be assured by the spacers. A measurement sequence would be initiated that would ascertain the functionality of the tested nozzles. The printhead may be repositioned to test additional nozzles. All of the nozzles may be tested at one time, or a subset of the nozzles may be tested.

Typically these measurements are performed on single row of nozzles within a given pen. For example, a black pen may have two vertical rows of nozzles, each vertical row containing up to several hundred nozzles. Once a given row is positioned over ink drop sensor 314 ink drops are fired from that row of nozzles, one nozzle at a time. Each nozzle may fire for 6/1,000 ths of a second for each nozzle measurement. For a nozzle containing 200 nozzles, testing will require approximately 1.2 seconds. After completion of the testing of the row for that pen, the next row of nozzles is measured until testing for the nozzles in the pen is completed. Information concerning failed nozzles would be stored and used to ensure isolation of the failed nozzle during subsequent print jobs and/or result in notification that maintenance is required.

Figure 5:
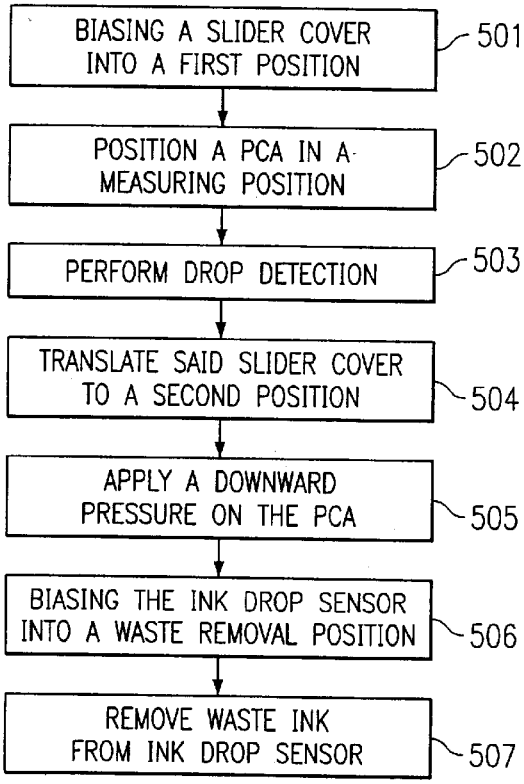
FIG. 5 is a flow chart illustrating a method of removing waste ink from an ink drop sensor.

FIG. 5 is a flow chart of a method of removing waste ink from an ink drop sensor. In Step 501, retractor spring 308 biases slider cover 304 into a first position. In Step 502, PCB 302 is positioned in measuring position 301 (FIG. 3). In Step 503, drop detection is performed as previously discussed. In Step 504, moveable pallet 303, or actuator, translates from a first position to a second position and pallet tower 306 of moveable pallet 303 engages slider cover extrusion 307 to translate slider cover 304 to a second position. In Step 505, slider arm 311 of slider cover 304 exerts, in cooperation with spring 312, a downward force on PCB 302 in a position to the right (FIG. 4) of PCB pivot 305. Note that spring 312 may be replaced by increasing the modulus of elasticity of slider cover 304. In Step 506, when a downward force is applied by slider arm 311 PCB 302 moves from measuring position 301 (FIG. 3) to waste removal position 401 (FIG. 4). In waste removal position 401, ink drop sensor 314 makes contact with absorbent pad 316 and in Step 507 waste ink is removed from ink drop sensor 314.

Note also that an embodiment of the present invention has been described in terms of a slider cover 304 including a slider arm 311 that contacts the PCA or PCB 207, a retractor spring 308 connected to the slider cover, and an actuator, such as moveable pallet 303 connecting the slider cover to effectuate the pivoting motion. Other pivoting devices are also envisioned in an embodiment of the present invention. For example, a toggle mechanism may be implemented that serves to vary the orientation of the PCB. Alternatively, in another embodiment of the present invention the cartridge itself may change the orientation, or another mechanical mechanism may be implemented to enable the changed orientation. Operation of said pivoting device causes the PCA to pivot between the first and second orientations such that waste ink is removed from the ink drop sensor when the PCA is in the second orientation. Of particular importance to the current invention is the spring loaded spacer or spacers that ensure repeatable distance is present between inkjet cartridge 112 and the ink drop sensor 314 and the reorientation, using a pivot, of PCB 302 between a measuring position and a waste removal position.

What is claimed is:

1. A waste ink removal apparatus for cleaning ink residue from an ink drop detection sensor in a printing mechanism, comprising:

an assembly pivotally supported by a pivot, said assembly pivoting between a first orientation and a second orientation;

an ink drop sensor located on said assembly;

a pivoting device connected to said assembly; and an absorbent pad located to contact said ink drop sensor when said assembly is in said second orientation;

wherein operation of said pivoting device causes said assembly to pivot between said first orientation and said second orientation and wherein waste ink is removed from said ink drop sensor when said assembly is in said second orientation.

2. The waste ink removal apparatus according to claim 1 wherein said pivoting device comprises:

a slider cover including a slider arm that contacts said assembly;

a retractor spring connected to a first end of said slider cover; and an actuator that contacts said slider cover and horizontally translates said slider cover in a manner to extend or retract said retractor spring, wherein said horizontal translation of said actuator causes said slider arm to contact a different portion of said assembly causing said assembly to pivot between said first orientation and said second orientation and wherein waste ink is removed from said ink drop sensor when said assembly is in said second orientation.

3. The waste ink removal apparatus according to claim 1 wherein said first orientation is a measuring position.

4. The waste ink removal apparatus according to claim 1 wherein said assembly further includes an upper portion and wherein said slider arm contacts said upper portion of said assembly.

5. The waste ink removal apparatus according to claim 1 further comprising:

an absorbent pad container operationally connected to said absorbent pad to store waste ink collected by said absorbent pad.

6. The waste ink removal apparatus according to claim 1 wherein said actuator is a moveable pallet.

7. The waste ink removal apparatus according to claim 5 wherein said assembly includes a pallet tower that contacts said slider cover.

8. The waste ink removal apparatus according to claim 1 further comprising:

a spring located between a main portion of said slider cover and said slider arm.

9. The waste ink removal apparatus according to claim 1 further comprising:

a spacer positioned on said assembly such that in said first orientation said spacer determines a distance between said assembly and a nozzle.

10. The waste ink removal apparatus according to claim 1 wherein said retractor spring is configured to position said assembly toward said first orientation.

11. A method of moving an ink drop sensor between a measuring position and a waste removal position, said method comprising the steps of:

positioning a pivotal assembly including an ink drop sensor in a measuring position;

pivoting said pivotal assembly between said measuring position and a waste removal position; and removing waste ink from said ink drop sensor when said pivotal assembly is in said waste removal position.

12. The method of claim 11 wherein said step of pivoting said pivotal assembly comprises:

biasing a slider cover into a first position with a retractor spring;

translating said slider arm to a second position with an actuator;

applying a downward pressure on said assembly from a slider arm attached to said slider cover; and biasing said ink drop sensor attached to said assembly into said waste removal position.

13. The method of claim 11 wherein said step of positioning said pivotal assembly in a measuring position is performed by applying a horizontally translating force on said bias cover.

14. The method of claim 11 wherein said step of translating said slider arm to a second position further comprises:

moving an actuator from a first position to a second position;

contacting said slider arm with said actuator such that said movement of said actuator causes said translation of said slider arm.

15. The method of claim 11 wherein said step of removing waste ink from said ink drop sensor is accomplished through a wicking action.

16. A printing mechanism comprising:

a printhead that selectively ejects ink;

an ink drop sensor that receives ink from the printhead and accumulates an ink residue thereon; and a waste ink removal system for cleaning ink residue from the sensor, the waste ink removal system comprising:

an assembly pivotally supported by a pivot, said assembly pivoting between a first orientation and a second orientation;

said ink drop sensor located on said assembly;

a slider cover including a slider arm that contacts said assembly;

a retractor spring connected to a first end of said slider cover;

an actuator that contacts said slider cover and horizontally translates said slider cover in a manner to extend or retract said retractor spring; and an absorbent pad located to contact said ink drop sensor when said assembly is in said second orientation;

wherein said horizontal translation of said actuator causes said slider arm to contact a different portion of said assembly causing said assembly to pivot between said first orientation and said second orientation and wherein waste ink is removed from said ink drop sensor when said assembly is in said second orientation.

17. The printing mechanism according to claim 16 wherein said first orientation is a measuring position.

18. The printing mechanism according to claim 16 wherein said assembly further comprises:

an upper portion and wherein said slider arm contacts said upper portion of said assembly.

19. The printing mechanism according to claim 16 further comprising:

an absorbent pad container operationally connected to said absorbent pad to store waste ink collected by said absorbent pad.

20. The printing mechanism according to claim 16 wherein said actuator is a moveable pallet.

21. The printing mechanism according to claim 16 wherein said assembly further comprises:

a pallet tower that contacts said slider cover.

22. The printing mechanism according to claim 16 further comprising:

a spring located between a main portion of said slider cover and said slider arm.

23. The printing mechanism according to claim 16 further comprising:

a spacer positioned on said assembly such that in said first orientation said determines a distance between said assembly and a nozzle.

24. The printing mechanism according to claim 16 wherein said retractor spring is configured to position said assembly toward said first orientation.

* * * * *